United States Patent [19]

Dettling et al.

[11] Patent Number: 4,731,994

[45] Date of Patent: Mar. 22, 1988

[54] APPARATUS FOR BURNING SOLID PARTICLES IN THE EXHAUST GAS OF INTERNAL COMBUSTION ENGINES

[75] Inventors: Hubert Dettling, Waiblingen; Rolf Leonhard, Schwieberdingen; Ulrich Projahn, Ditzingen, all of Fed. Rep. of Germany

[73] Assignee: Robert Bosch GmbH, Stuttgart, Fed. Rep. of Germany

[21] Appl. No.: 30,186

[22] Filed: Mar. 26, 1987

[30] Foreign Application Priority Data

Jun. 30, 1986 [DE] Fed. Rep. of Germany ..... 3621913

[51] Int. Cl.[4] ..... F01N 3/26

[52] U.S. Cl. ..... 60/303; 422/173; 422/175; 422/182; 422/183

[58] Field of Search ..... 60/303, 286; 422/173, 422/175, 182, 183

[56] References Cited

U.S. PATENT DOCUMENTS

| | | | |
|---|---|---|---|
| 3,460,916 | 8/1969 | Aronsohn | 60/286 |
| 4,318,887 | 3/1982 | Leistritz | 422/173 |
| 4,672,808 | 6/1987 | Leonhard | 60/286 |

FOREIGN PATENT DOCUMENTS

| | | | |
|---|---|---|---|
| 2606333 | 8/1977 | Fed. Rep. of Germany | 422/173 |
| 2900318 | 7/1980 | Fed. Rep. of Germany | 422/173 |
| 3424196 | 8/1985 | Fed. Rep. of Germany . | |

*Primary Examiner*—Douglas Hart

*Attorney, Agent, or Firm*—Edwin E. Greigg

[57] ABSTRACT

An apparatus for burning solid particles, in particular soot particles, in the exhaust gas of internal combustion engines having a combustion chamber and an ignition burner connected coaxially through an overflow opening. The combustion chamber includes an annular cup portion forming a hot combustion chamber that is open toward the overflow opening, and downstream of this hot combustion chamber has a plurality of labyrinthine annular conduits toward which a plunger tube extends centrally toward the combustion chamber, through which tube a flow of exhaust gas carrying the soot particles is directed into the hot combustion chamber. The flow of exhaust gas having the soot particles emerges into the hot combustion chamber through radial outlets transversely to the direction of extension of the ignition flame that is propagating through the overflow opening. The soot particles that are supplied are for the most part burned in the hot combustion chamber, and the remainder is burned in the labyrinthine conduits. The exhaust gas from the burner is carried away in a counter current to the exhaust gas laden with soot particles that is delivered to the plunger tube.

20 Claims, 7 Drawing Figures

47
48
5
40
54
37
35
41
55
45
30
43
43
42
36
31
3
42
33
34
32
4
7
6
11
19'
1
19
56
14
12
17
2
16
18
50
20
10
21
22
51
23
25
24
27
52
53
46
26
15

APPARATUS FOR BURNING SOLID PARTICLES IN THE EXHAUST GAS OF INTERNAL COMBUSTION ENGINES

BACKGROUND OF THE INVENTION

The invention relates to a combustor apparatus for burning solid particles in the exhaust gas of internal combustion engines.

For removing soot from the exhaust gas of internal combustion engines, in particular Diesel engines, it is already known from German Offenlegungschrift No. 34 24 196 to filter the soot particles out of the exhaust gas with an electrostatic soot shunt and deliver them for burning in a partitioned-off flow to a combustor apparatus.

In a combustor apparatus of the above type, the outlet of the plunger tube, which directs a flow of exhaust gas laden with soot particles into the combustion chamber, is oriented coaxially toward the overflow opening to the preparation chamber of the ignition burner, so that the particles aimed with the exhaust gas that flows directly at the pilot flame have no more than a brief dwell time in the flame zone. For this reason, it can happen that with soot particles of varying size the combustion will not be carried out completely.

OBJECT AND SUMMARY OF THE INVENTION

The combustor apparatus according to the invention has the advantage over the prior art that a hot core zone forms in the combustion flame, maintained at a limited volume by an annular cup-like structure, and in this core zone the temperature is far above the temperature of ignition of the soot particles. A recirculation flow also arises in this area during combustion, so that the dwell time of the soot particles in the hot zone is increased and reliable combustion is therefore assured.

By means of an advantageous feature the dwell time of the soot particles in the region having a high temperature is prolonged, thereby providing a still further increase in the completeness of combustion.

By means of an additional feature defined herein, the flow of exhaust gas supplied, and the soot particles entrained with it, are preheated, so that in the hot combustion chamber they are heated to reaction temperature in a very short time. A further advantage is that because of the residual oxygen component in the exhaust gas flow, preliminary reactions are possible, which also favorably affect the completeness of combustion. High thermal utilization is also attained by the heat exchange between the outflowing combustion gas and the supplied flow of exhaust gas.

The invention will be better understood and further objects and advantages thereof will become apparent from the ensuing detailed description of preferred embodiments of the invention, taken in conjunction with the drawings.

DESCRIPTION OF THE PREFERRED EMBODIMENTS

Figure 1:
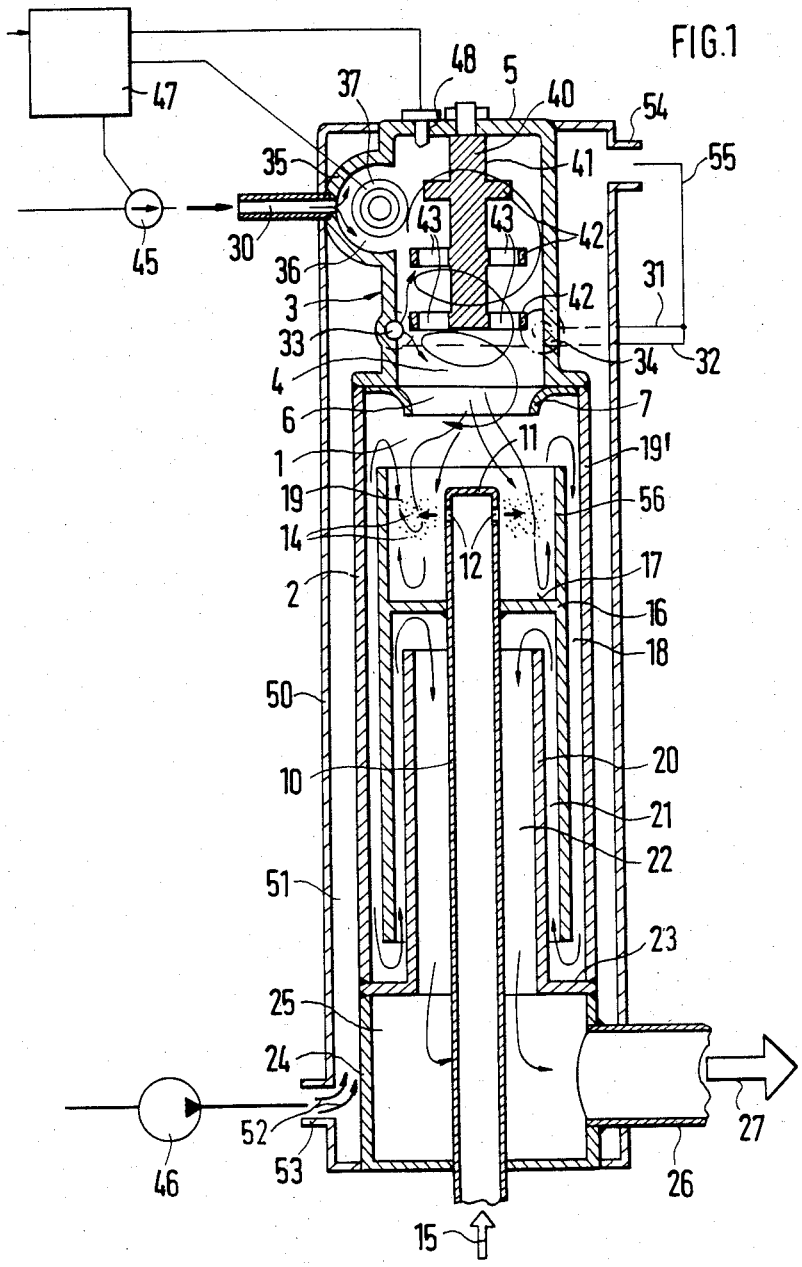
FIG. 1 is a longitudinal section through a combustor apparatus.

For removing soot particles from the exhaust gas of internal combustion engines, in particular Diesel engines, the exhaust gas flow is first directed thorugh an electrostatic soot shunt, and through a centrifugal filter, from one outlet of which the exhaust gas emerges is to the maximum possible extent free of soot and other solid particles, while emerging from another outlet is a partial exhaust gas flow that has been enriched with the filtered-out soot and solid particles. To render the soot harmless, the partial exhaust gas flow is delivered to a combustor apparatus, which is described below and is shown in the drawing.

The combustor apparatus has a combustion chamber 1 in a cylindrical jacket 2 and adjoining this jacket has an axially aligned ignition burner 3 with a fuel mixture preparation chamber 4 in a cap-like housing 5. The combustion chamber 1 and the preparation chamber 4 communicate via an overflow opening 6 in a partition 7, in which the overflow opening 6 has the form of a nozzle converging toward the combustion chamber 1.

Protruding coaxially into the cylindrical combustion chamber 1 toward the overflow opening 6, from the end opposite the ignition burner 3, is a plunger tube 10, the end 11 of which is axially sealed and is spaced apart by a certain axial distance from the overflow opening 6. Near its end 11, the plunger tube 10 has a plurality of radial outlets 12, for example two in number, through which the exhaust gas flow 15, laden with soot particles 14, flows through the plunger tube 10 into the combustion chamber 1. The outlets 12 are located inside a coaxial pipe segment 16, which is secured to the plunger tube 10 with a radial partition 17, so that an annular gap 18 is formed between the outside circumference of the pipe segment 16 and the inside of the jacket 2 of the combustion chamber 1. A hot combustion chamber 19, which is open toward the overflow opening 6, is surrounded in the manner of an annular cup having a limited volume by the partition 17 and the portion of the pipe segment 16 that surrounds the outlets 12 of the plunger tube 10. In this hot combustion chamber 19, the soot particles 14 emerging from the outlets 12 are ignited and for the most part burned. The resultant combustion gases and the incompletely burned soot particles 14 emerge at the outer circumference of the hot combustion chamber 19 and are deflected toward the gap 19' at the face edge of the pipe segment 16.

Protruding coaxially into the portion of the pipe segment 16 located axially opposite the hot combustion chamber 19 is a second pipe segment 20 of lesser diameter than pipe 16, which is secured to the jacket 2 of the combustion chamber 1 with a flange 21 directly opposite the end of pipe 16. The pipe segments 16 and 20 divide the combustion chamber 1 into a plurality of annular gaps 18, 21 and 22 communicating with one another, which form a labyrinth system and extend the flow path of the combustion gas. By this embodiment of the combustion chamber 1, the dwell time of the combustion gas is prolonged, and the completeness of combustion is thereby increased. Adjoining the outlet end of the innermost annular gap 22 is a collection chamber 25, embodied by an annular wall portion in axial alignment with jacket 2; the plunger tube 10 protrudes through this collection chamber 25, and an exhaust gas fitting 26 for removing the burner exhaust gases 27 leads away from collection chamber 25. Because of the coaxial arrangement of the plunger tube 10 with respect to the innermost annular gap 22 formed by the pipe segment 20, a countercurrent heat exchanger is formed, which assures high heat utilization. The hot burner exhaust gases, via the plunger tube 10, heat the flow of exhaust gas, laden with soot particles, which is carried through it, so that the soot particles 14 emerging from the outlets 12 are brought to reaction temperature within a short time. Because of the preheating that takes place in the plunger tube 10, preliminary reactions that favorably affect the completeness of combustion are already possible in Diesel exhaust gases, which have a residual oxygen content.

To generate an ignition or pilot flame, which propagates out of the preparation chamber 4 of the ignition burner 3 through the overflow opening 6 toward the end 11 of the plunger tube 10 into the hot combustion chamber 19, one fuel supply line 30 and one or more—typically, two—air supply lines 31, 32 discharge into the preparation chamber 4 via openings 33 and 34. The inlet openings 33, 34 of the air supply lines 31, 32 discharge with the same orientation and at a tangent into the preparation chamber 4 near the partition 7, so that the combustion air flows with a swirl into the preparation chamber 4. The fuel supply line 30 discharges into a semi-cylindrical bulge 36 of the preparation chamber 4 that is formed by an extension 35 which is radially eccentric relative to the axis of the ignition burner. Protruding into this eccentric bulge 36 is a glow plug 37, known per se, which is supplied with an electric current for starting the combustor apparatus. A rotationally symmetrical glow element 40 is disposed centrally in the preparation chamber 4 of the ignition burner 3. The glow element 40 is secured to the end wall of the housing 5 and extends toward the overflow opening 6. The glow element 40 has a plurality of annular ribs 42, for example three in number, which are radially offstanding from a shaft 41 and of which the annular ribs 42 near the overflow openings have uniformly distributed openings 43.

To generate the pilot flame and to furnish the air required for the combustion of the soot particles 14, a control valve 45 or a pump is incorporated into the fuel supply line 30, and a blower 46 is incorporated into the air supply line; both the control valve and the blower are controlled by a central control unit 47 such that the quantities of fuel and air required for the combustion can be supplied in a metered manner.

The glow plug 37 is also connected to the control unit 47. The control unit 47 is also, for monitoring the flame in the preparation chamber 4 of the ignition burner 3, connected to a sensor 48 inserted into the housing, which may be embodied as an optical sensor, a temperature sensor, or an ion current sensor.

For good utilization of the heat of the combustor apparatus, the apparatus is insulated from the outside. To this end, an outer shell 50 surrounds the housing 5 of the ignition burner 3, the jacket 2 of the combustion chamber 1 and the annular wall 24 of the collection chamber 25. The air 52 required for combustion is forced by the blower 46 through the annular chamber 51 formed by the shell 50 and in the process is heated and simultaneously acts as coolant for the combustor apparatus. The shell 50 has an inlet fitting 53 in the vicinity of the collection chamber 25 and an outlet fitting 54 in the vicinity of the ignition burner 3, the outlet fitting communicates via a line 55 with the air supply lines 31, 32 which direct air through openings 33 and 34 within chamber 4.

For putting the combustion apparatus described above into operation, first the glow plug 37 is supplied with current, and preferably liquid fuel is carried through the fuel supply line 30 to the bulge 36 of the preparation chamber 4. At the same time, the blower 46 moves combustion air into the preparation chamber 4 through the two inlet openings 33, 34. Once a predetermined temperature has been reached, the fuel-air mixture in the preparation chamber 4 ignites, and the flame propagates through the overflow opening 6 into the hot combustion chamber 19. After some time, the glow element 40 reaches the ignition temperature, so that the flame formation is stabilized. The glow plug 37 can now be switched off. The ignition flame, which because of the tangential supply of air propagates with a swirl through the overflow opening 6 into the hot combustion chamber 19, is concentrated in the axial direction by the embodiment of the overflow opening 6 as a nozzle, so that in the center of the hot combustion chamber 19 a very hot core combustion zone is formed, in which the soot particles 14 are rapidly brought to reaction temperature. After a recirculation in the combustion chamber 19, the exhaust gases from combustion 19 flow through gap 19', with further reaction taking place, through a relatively long path, formed by the annular gaps 18, 21 and 22, into the collection chamber 25 and from there flows out through outlet 27 in the form of clean, cooled exhaust gas.

Figure 2:
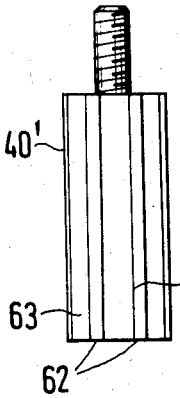
FIG. 2 shows a glow element in a side view.
Figure 4:
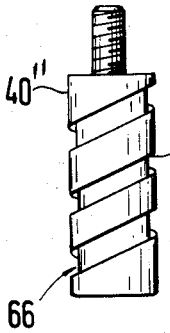
FIG. 4 shows a third exemplary embodiment of a glow element in a side view.
Figure 3:
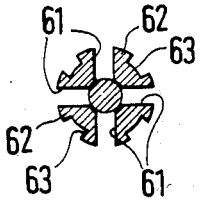
FIG. 3 shows the glow element of FIG. 2 in cross section perpendicular to the axis.
Figure 5:
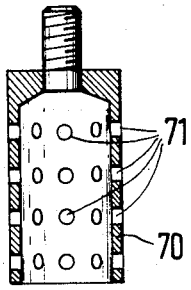
FIG. 5 shows a fourth exemplary embodiment of a glow element in longitudinal section.
Figure 6:
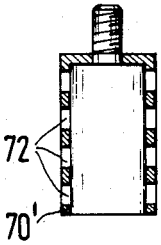
FIG. 6 shows a fifth exemplary embodiment of a glow element in longitudinal section.
Figure 7:
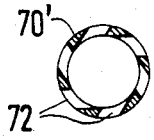
FIG. 7 shows the glow element of FIG. 6 in a cross section perpendicular to the axis.

In addition to the embodiment of the glow element shown in FIG. 1, which has surfaces that promote gas mixing and that steer the flame toward the overflow opening 6 to the combustion chamber 1, other embodiments are also possible. In principle, rotationally symmetrical forms are preferred. In the exemplary embodiment of FIG. 2, the glow element 40' has a basically cylindrical shape, into which four longitudinal grooves 61 are machined crosswise, thereby forming four longitudinal ribs 62. Additional longitudinal grooves 63 are molded into the radially outer surface of the longitudinal ribs 62; the depth of these grooves 63 is less than that of the grooves 61. Instead of axially parallel longitudinal grooves, it is also possible to machine only one or two grooves 65 into the glow element 40", as shown in the exemplary embodiment of FIG. 4; these grooves 65 extend helically and thus give the glow element the form of a worm 66. Instead of a compact embodiment, the glow element 40 can also take the form of a cylindrical sheath 70, the jacket of which is pierced by a plurality of openings 71, 72. In the exemplary embodiment of FIG. 5, the openings 71 extend radially with respect to the longitudinal axis of the glow element. Contrarily, in the exemplary embodiment of FIGS. 6 and 7, the openings 72 pierce the sheath 70' obliquely with respect to the radial, so that a swirl is imparted to the gases passing through them.

It should also be noted that the portions of the combustor apparatus that are exposed to high temperatures, such as the glow element 40 in particular, comprise a material that is resistant to high temperatures, such as a nickel-based alloy known by the trade name "Inconel", or ceramic.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An apparatus for burning solid particles, in particular soot particles, in an exhaust gas of internal combustion engines, comprising an overflow opening (6), a cylindrical first combustion chamber (1) formed by a jacket (2), a fuel mixture preparation chamber (4) communicating with said combustion chamber (1) through said overflow opening (6), an ignition burner for generating a pilot flame in said preparation chamber, said pilot flame being oriented through said overflow opening into said combustion chamber (1), a plunger tube (10) protruding coaxially into said combustion chamber toward said overflow opening, said plunger tube (10) having at least one outlet (12) through which a flow of gas (15) laden with the solid particles (14) is directed into said combustion chamber, a combustion gas removal tube (20) partially surrounding the plunger tube (10) which carries a combustion gas (27) to an exhaust outlet (26), said at least one outlet (12) of said plunger tube (10) arranged to discharge radially, and a second combustion chamber (19) opening toward said overflow opening (6) and spaced apart radially from the wall of the first combustion chamber (1) is arranged to surround said plunger tube in the vicinity of said at least one outlet in such a manner that a combustion flame ignited by the pilot flame is retained within a limited volume having a hot core zone.

2. An apparatus as defined by claim 1, in which a plurality of annular conduits (18, 21, 22) merging with one another in labyrinthine fashion extends coaxially with a shell (50) and is attached downstream of an annular cup (56) surrounding said second combustion chamber (19) and said plunger extends into said second combustion chamber (19) coaxial with said annular conduits.

3. An apparatus as defined by claim 1, in which a plurality of annular conduits (18, 21, 22) are defined between said jacket, a pipe segment (16), said combustion gas removal tube and said plunger tube, respectively, said annular conduits extending coaxially within a shell (50) to merge with one another in labyrinthine fashion and said plunger tube extends into said second combustion chamber (19) coaxially within said pipe segment, said plunger tube, said pipe segment and a partition (17) extending therebetween serving to define an annular cup portion (56) comprising said second combustion chamber.

4. An apparatus as defined by claim 2, in which said annular cup includes a cylindrical jacket which is lengthened toward said exhaust outlet and together with said jacket (2) of the first combustion chamber (1) and an inner pipe segment (20) forms the annular conduits (18, 21, 22) which surrounds said plunger tube.

5. An apparatus as defined by claim 1, in which said annular cup (56) is oriented axially with said overflow opening (6), which is embodied as a nozzle having a cross section converging in a direction toward the cup.

6. An apparatus as defined by claim 2, in which said annular cup (56) is oriented axially with said overflow opening (6), which is embodied as a nozzle having a cross section converging in a direction toward the cup.

7. An apparatus as defined by claim 3, in which said annular cup (56) is oriented axially with said overflow opening (6), which is embodied as a nozzle having a cross section converging in a direction toward the cup.

8. An apparatus as defined by claim 4, in which said first combustion chamber (1) is adjoined by a collection chamber (25) surrounded by an annular element (24) and leading to said exhaust outlet (26).

9. An apparatus as defined by claim 5, in which said first combustion chamber (1) is adjoined by a collection chamber (25) surrounded by an annular element (24) and leading to said exhaust outlet (26).

10. An apparatus as defined by claim 6, in which said first combustion chamber (1) is adjoined by a collection chamber (25) surrounded by an annular element (24) and leading to said exhaust outlet (26).

11. An apparatus as defined by claim 1, in which a plurality of radial nozzles (12) are disposed near an end (11) of said plunger tube (10).

12. An apparatus as defined by claim 2, in which a plurality of radial nozzles (12) are disposed near an end (11) of said plunger tube (10).

13. An apparatus as defined by claim 3, in which a plurality of radial nozzles (12) are disposed near an end (11) of said plunger tube (10).

14. An apparatus as defined by claim 4, in which a plurality of radial nozzles (12) are disposed near an end (11) of said plunger tube (10).

15. An apparatus as defined by claim 7, in which a plurality of radial nozzles (12) are disposed near an end (11) of said plunger tube (10).

16. An apparatus as defined by claim 8, in which a plurality of radial nozzles (12) are disposed near an end (11) of said plunger tube (10).

17. An apparatus as defined by claim 1, in which a glow element (40) is disposed in the fuel preparation chamber (4).

18. An apparatus as defined by claim 2, in which a glow element (40) is disposed in the fuel preparation chamber (4).

19. An apparatus as defined by claim 3, in which a glow element (40) is disposed in the fuel preparation chamber (4).

20. An apparatus as defined by claim 4, in which a glow element (40) is disposed in the fuel preparation chamber (4).

* * * * *